United States Patent [19]

Walker

[11] 4,386,038

[45] May 31, 1983

[54] EVAPORATIVE COOLER APPARATUS

[75] Inventor: Dean M. Walker, Loveland, Colo.

[73] Assignee: Walker Manufacturing Company, Fort Collins, Colo.

[21] Appl. No.: 323,671

[22] Filed: Nov. 20, 1981

[51] Int. Cl.[3] ..... B01F 3/04

[52] U.S. Cl. ..... 261/80; 261/DIG. 46

[58] Field of Search ..... 261/80, 92, DIG. 46; 138/89; 415/90; 417/435; 239/542

[56] References Cited

U.S. PATENT DOCUMENTS

| | | | |
|---|---|---|---|
| 2,246,069 | 6/1941 | Schechtel et al. | 261/92 |
| 3,189,328 | 6/1965 | Hotchkiss et al. | 261/DIG. 46 |
| 3,196,892 | 7/1965 | Savage et al. | 261/DIG. 46 |
| 3,252,691 | 5/1966 | Getzin et al. | 261/80 |
| 3,352,297 | 11/1967 | Martin et al. | 261/80 |
| 3,386,711 | 6/1968 | Williams | 261/DIG. 46 |
| 3,482,785 | 12/1969 | Chapin et al. | 239/542 |
| 3,574,312 | 4/1971 | Miller | 138/89 |
| 3,758,086 | 9/1973 | Pugh | 261/DIG. 46 |
| 3,834,680 | 9/1974 | Yost et al. | 261/92 |
| 4,094,935 | 6/1978 | Walker et al. | 261/80 |

FOREIGN PATENT DOCUMENTS

| | | | |
|---|---|---|---|
| 1027845 | 3/1978 | Canada | 261/DIG. 46 |

*Primary Examiner*—Tim R. Miles

*Attorney, Agent, or Firm*—Hugh H. Drake

[57] ABSTRACT

An evaporative cooling system includes a housing with an air outlet and inlet structure. An endless belt is of a material to which a liquid may cling and is transparent to air flow so as to achieve evaporation. A portion of the belt extends through a reservoir and the belt is driven in movement therethrough. Blower apparatus is disposed to draw air through the inlet and the belt and exhaust the air through the outlet. A metering drum controllably exhausts reservoir liquid for the purpose of reducing contamination.

7 Claims, 11 Drawing Figures

EVAPORATIVE COOLER APPARATUS

The present invention relates to evaporative cooler apparatus. More particularly, it pertains to an arrangement of structure for such apparatus which enables the removal of an undesirable collection of impurities.

U.S. Pat. No. 3,834,680, issued Sept. 10, 1974, discloses what has proved to be a highly successful evaporative-type cooler. The cooler uses a cylindrical drum or belt of a material to which water may cling and which is sufficiently transparent to the flow of air therethrough as to achieve evaporation of the water on the drum by the air. A reservoir of water is maintained in a position through which a portion of the drum extends. The air is propelled through the drum, and, in turn, the lower portion of the drum is moved through the water in the reservoir. The air propelled through the moistened material on the drum is exhausted into a vehicle cab or other enclosure.

In principle, the apparatus of the aforementioned patent is not limited in cooling capacity. That is, it and all of its components proportionately, may be expanded in physical size as necessary to achieve the desired degree of cooling of a larger enclosure than, for example, a vehicle cab. For a comparatively large residential or office enclosure, however, that cooler tends to become unduly bulky.

An improved approach, therefore, become the subject of U.S. Pat. No. 4,094,935, issued June 13, 1978. It features a pair of endless belts which are individually disposed within a housing and adjacent to respective ones of inlet openings. A portion of each belt extends through a reservoir. Blower apparatus, also disposed within the housing between the belts, draws air through the inlets and the belts and exhausts the cooled air through an outlet opening.

One difficulty which persists in the long-term operation of evaporative coolers of the foregoing and other kinds arises as a result of the existence of contaminates present in local water sources. Such contaminates typically are dispersed minerals, such as the various calcium compounds present in so-called hard-water areas. However, they also may include organic matter. Over a period of time, such contaminates decrease the evaporative efficiency of the liquid contained within the reservoir and clog the air flow interstices of the moveable belt or drum to which the liquid clings and through which the air has to pass.

One answer has been simply been to dump the contents of the reservoir whenever it was observed that the belt had acquired a build up of the contaminates. At the same time, the user would seek either to clean the belt or replace it before adding a fresh supply of the liquid. Before performing those operations, the cooling efficiency of the unit would have been gradually decreasing.

In an effort to amiliorate this problem, a standpipe was considered for use in apparatus like that in the aforesaid U.S. Pat. No. 4,094,935. The standpipe exhausted to the exterior and projected upright to the level of water desired in the reservoir. A small vertical slot was disposed in the upper peripheral end portion of the standpipe in an effort to continually meter out a very small portion of the water which deliberately was wasted. As that wasting occurred, the float valve which controlled the reservoir water level would allow a generally equal amount of fresh water to be added to the reservoir. Of course, the same float valve also was necessarily included to replenish the reservoir supply as the water was evaporated in the performance of the overall cooling function.

Such deliberate continual wasting of a small quantity of the water did serve to reduce the concentration of the contaminate and, thereby, increase the intervals of time before it became necessary to clean or change the evaporative belts. However, a degree of problem continued, because the small slot in the upper end of the standpipe tended eventually to become clogged with the same contaminating material and economically-available float control valves for the reservoir were found not to be sufficiently accurate in level maintenance to provide dependable operation with that approach. That is, it was found extremely difficult, at least at reasonable cost, to achieve a happy medium as between excessive wasting of the water and insufficient wasting for the purpose of obtaining the desired reduction and concentration of the contaminates. Of course, that approach would have been even more unsuitable for a vehicular-mounted evaporative cooler.

It is, accordingly, a general object of the present invention to provide a new and improved evaporative cooling apparatus that addresses such problems and affords solutions for the same.

Another object of the present invention is to provide a new and improved evaporative cooling apparatus of the foregoing character which may be implemented without the need for any additional source of motive power.

A further object of the present invention is to provide a new and improved evaporative cooling apparatus which achieves a controlled positive displacement of wasted reservoir liquid to be replaced without requiring extensive modification of existing units and which is economical of that adaptation.

The invention thus pertains to an evaporative cooling apparatus in which a belt of material, to which a liquid may cling and which is transparent to air flow therethrough so as to achieve evaporation of said liquid, is moved through a reservoir of the liquid and then exposed to the air flow. In accordance with a perferred mode of implementation, there is a drum which has a peripheral wall closed by space-opposed end walls. The drum is mounted for circumferential movement of its periphery. Separating means disposed between those end walls define a plurality of compartments successively spaced circumferentially around the axis of rotation of the drum. Defined in at least one of the walls are means for inletting liquid into respective ones of the compartments while immersed in the liquid contained within the reservoir and for outletting the liquid from the corresponding compartment in a controllable amount as the drum revolves. Also included are means for effecting rotation of the drum as the belt is moved and for diverting the liquid outletted from the drum away from the reservoir.

The features of the present invention which are believe to be patentable are set forth with particularity in the appended claims. The organization and manner of operation of the invention, together with further objects and advantages thereof, may best be understood by reference to the following description taken in connection with the accompanying drawings, in the several figures of which like reference numerals identify like elements, and in which:

Figure 1:
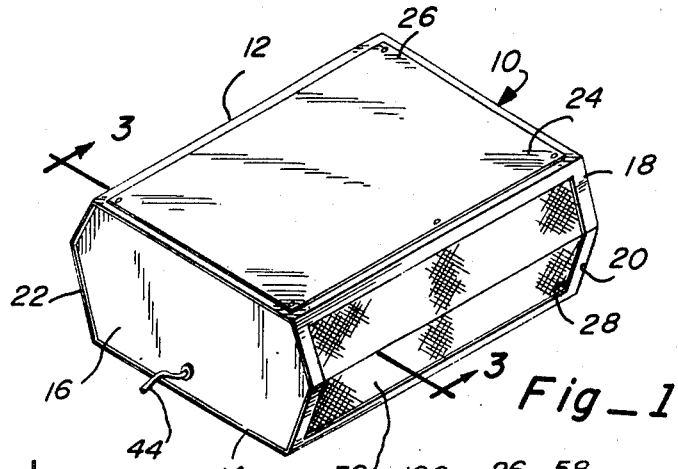
FIG. 1 is a perspective view of an evaporative cooling unit which constitutes one embodiment of the present invention.
Figure 2:
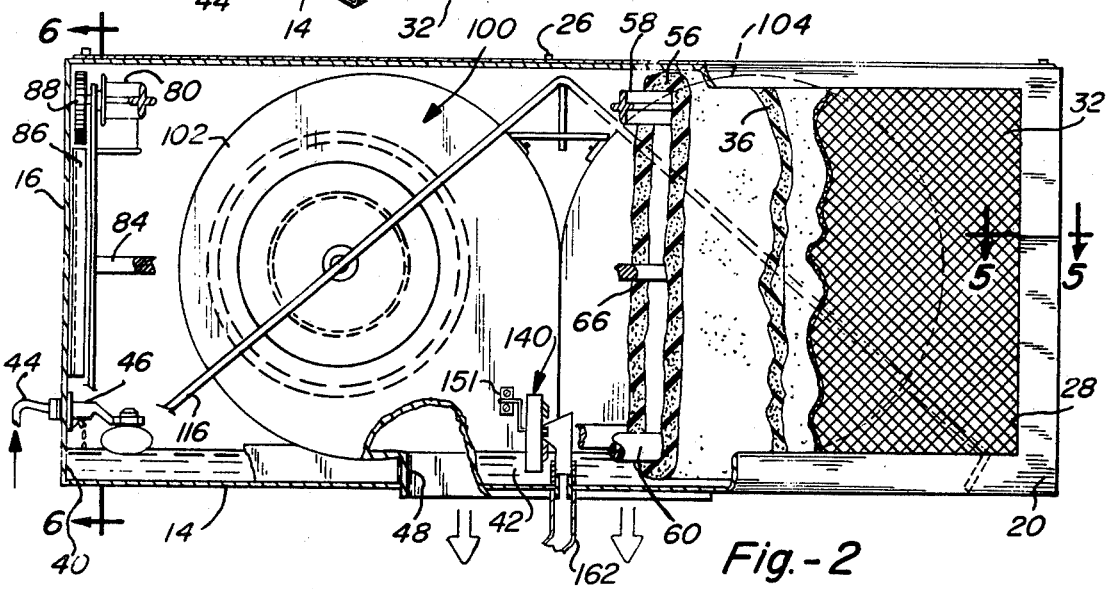
FIG. 2 is a side-elevational view, partially broken away, of the unit of FIG. 1.

While the improvements to which the present application pertains may be embodied into a variety of different cooler apparatus, it is convenient for ease of explanation and understanding to explain those improvements as incorporated into an evaporative cooler unit of the kind described in the aforesaid U.S. Pat. No. 4,094,935. Accordingly, that patent is incorporated herein by reference and made a part hereof.

An evaporative cooler unit 10, therefore, includes a housing 12 that has a bottom wall 14, space-opposed end walls 16 and 18, generally vertical side walls 20 and 22 and a removable upper cover 24 secured in place by suitable fasteners as at 26. Substantially occupying the areas of side walls 20 and 22 are respective air-inlet openings 28 and 30 across which corresponding open-mesh grills 32 and 34 are fixed. Secured against the inner surface of grills 32 and 34 preferably are respective filters 36 and 38 of a dry material such as natural fiber or suitable syntehetic.

In the lower portion of housing 12 is defined a reservoir 40 for evaporative liquid 42. In this case, that liquid is simply water. Replenishment of the supply of the water within reservoir 40 is by way of an inlet hose or pipe 44 with the quantity of supply being under the control of a conventional float valve 46.

Figure 3:
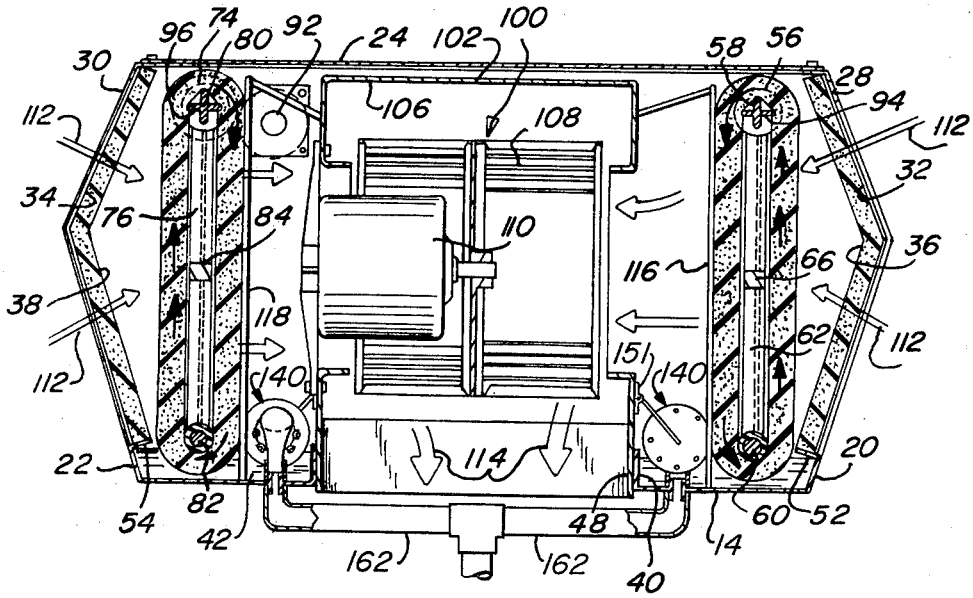
FIG. 3 is a cross-sectional view taken along the line 3—3 in FIG. 1.
Figure 4:
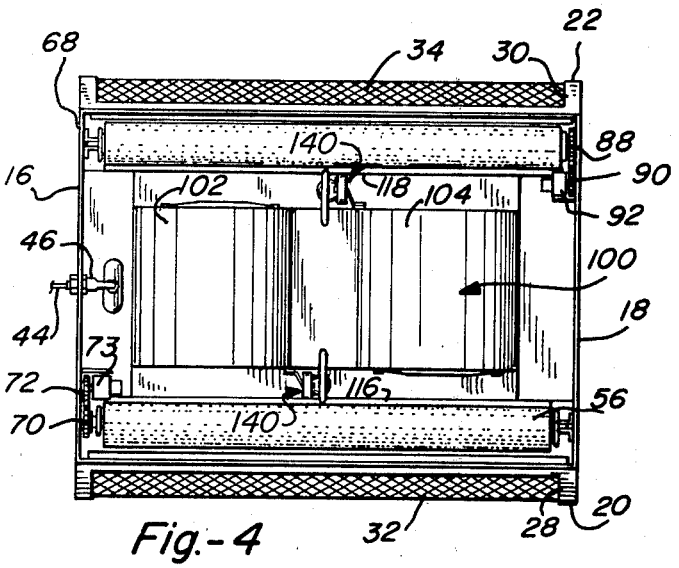
FIG. 4 is a top plan view, with an upper cover removed, of the unit of FIG. 1.
Figure 5:
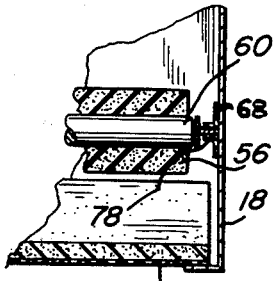
FIG. 5 is a fragmentary cross-sectional view taken along the line 5—5 in FIG. 2.
Figure 6:
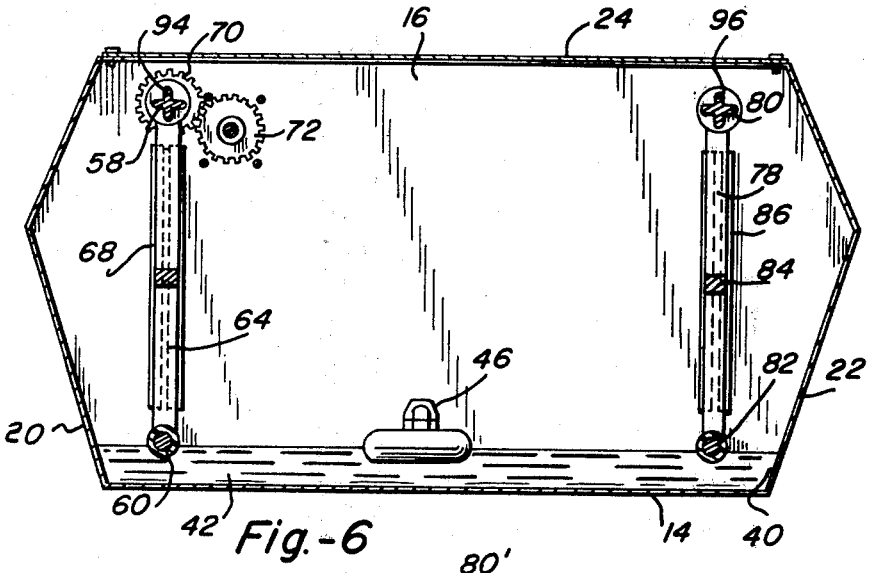
FIG. 6 is a cross-sectional view taken along the line 6—6 in FIG. 2.

Formed centrally through bottom wall 14 is an air-outlet or exhaust opening 48 the walls of which extend through and then project above reservoir 40. Thus, the water surrounds outlet 48. Projecting horizontally outward from those walls of opening 48 is a baffle 50 see FIG. 3, U.S. Pat. No. 4,094,395. Outer baffle elements 52 and 54 project respectively inward from side walls 20 and 22 and above the surface of the water in reservoir 40. Those baffles tend to shield the surface of the water in reservoir 40 from the effects of air currents flowing through the unit.

Disposed immediately inside inlet opening 28 is an endless belt 56 of a material to which water will cling and which is yet sufficiently transparent to the flow of air therethrough as to achieve evaporation, of such water clinging on the belt, by the air. A suitable material is polyurethane foam. Desirably, that material may be coated with a polyvinyl chloride layer in order to inhibit deterioration from ultraviolet radiation.

Belt 56 is mounted for movement around the combination of a respective pair of rollers 58 and 60 that are fixedly spaced-apart on a frame 62. Frame 62 includes bars 64 at opposite ends of rollers 58 and 60 and to which the opposite end portions of the latter are correspondingly journaled for rotation. Within frame 62 is a rod 66 that is secured between the mid-portions of the respective ones of bars 64. With the belt mounted upon rollers 58 and 60, it will be noted that belt 56 conforms to a shape in which it has a hollow oblong cross section elongated in the vertical direction.

The assembly of belt 56 upon rollers 58 and 60 is removably mounted within housing 12 by means of vertically-oriented channel members 68. Thus, the entire assembly that includes belt 56 may be easily removed for cleaning or the replacement of a new evaporative-filter element. When the belt assembly is mounted in place within the housing, the lower end portion of belt 56 projects into reservoir 40.

On one end of upper roller 58 is a spur gear 70. When the assembly of frame 62 and belt 56 is lowered into place as defined by channel members 68, gear 70 meshes into engagement with a mating gear 72 powered for rotation by a reduction-geared motor 73.

A preferably identical arrangement is disposed on the opposite side of housing 12 and just inside of opening 30. Thus, a belt 74 is mounted upon a frame 76 that includes end bars 78 which journal rollers 80 and 82 and also includes a rigidifying central rod 84. Channel members 86 slidably receive bars 78 so as to mount the belt assembly in place. A spur gear 88 at one end of roller 80 mates with a driving gear 90 powered by a gear-reduced motor 92.

As so far shown, upper rollers 58 and 80 are in each case splined so as to define longitudinal ribs 94 and 96, respectively, that serve to frictionally engage the corresponding belts 56 and 74. Accordingly, a drive train is completed in each case for moving belts 56 and 74 through water 42 in reservoir 40.

A blower apparatus 100 is disposed within housing 12 between belts 56 and 74 for drawing air through inlet openings 28 and 30, belts 56 and 74 and then exhausting that air through outlet opening 48. While the blower apparatus may take various forms, it preferably utilizes a centrifugal-type blower for compactness of space and efficiency of operation. Considering desired compactness, it has been found efficient to utilize a pair of like centrifugal blowers 102 and 104. Blower 102 is illustrative in its inclusion of a manifold 106 and a squirrel-cage rotor 108 powered by an electric motor 110. Of course, the blowers are in themselves conventional sub-assemblies. In operation, they serve to draw air inwardly through openings 28 and 30 as indicated by arrows 112 (FIG. 3) and then through corresponding belts 56 and 74. The air is then exhausted by the blowers through outlet opening 48 as indicated by arrows 114.

Also included within housing 12 are braces 116 and 118 anchored between housing 12 and blower apparatus 100. Braces 116 and 118 are also so disposed as to prevent any tendency of expansion of the air-outlet side of belts 56 and 74 as a result of the incoming air flow.

Figure 8:
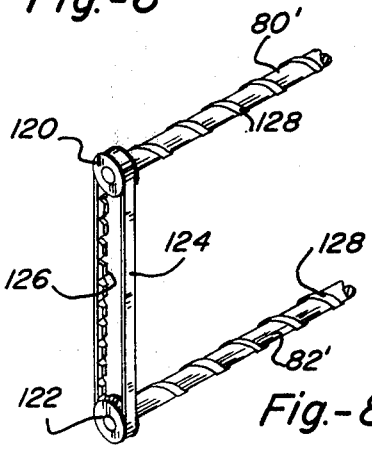
FIG. 8 is a perspective view of an alternative of a component shown in preceding ones of the figures.
Figure 7:
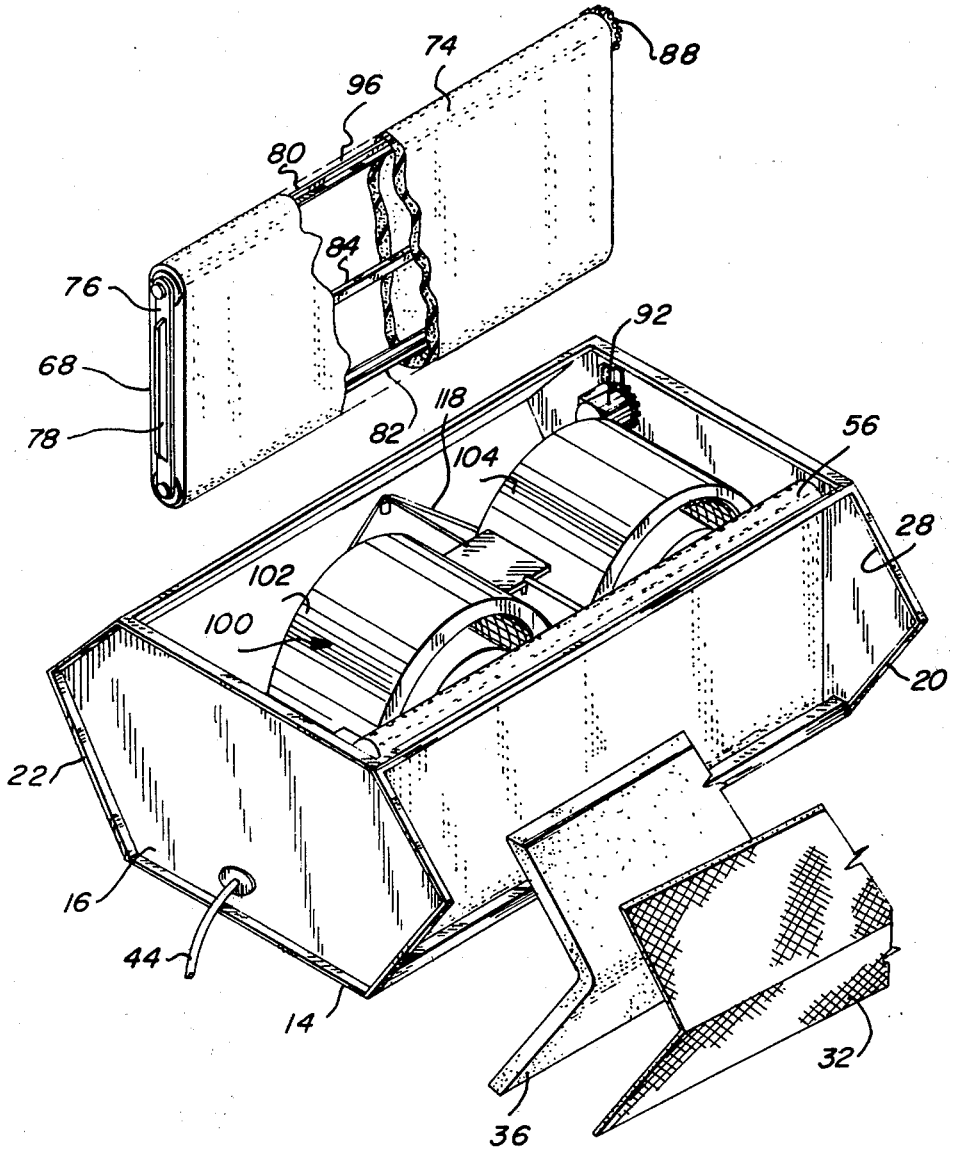
FIG. 7 is an exploded perspective view of the unit of FIG. 1 and, again, with the upper cover removed.
Figure 9:
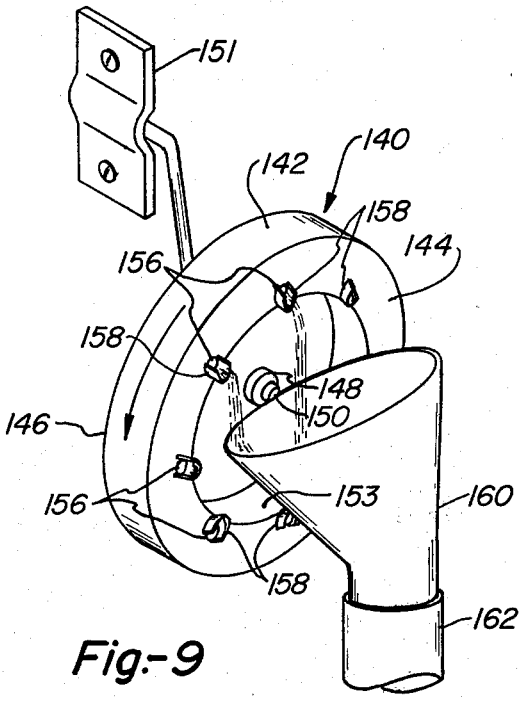
FIG. 9 is an enlarged, fragmentary perspective view of a sub-assembly shown in FIGS. 2, 3 and 4.
Figure 11:
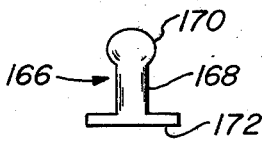
FIG. 11 is a side-elevation view of a sub-component which may be used with the component of FIG. 10.
Figure 10:
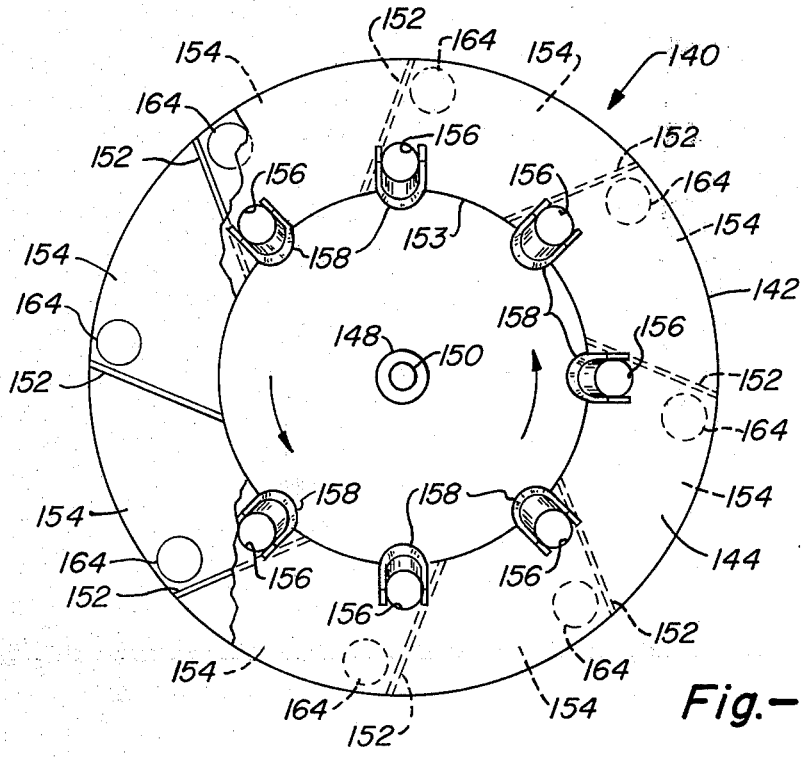
FIG. 10 is a further-enlarged front elevational view, partially broken away, of a principal component shown in FIG. 9.

As so far described, all driving movement is assigned to the upper rollers by way of their splined or ribbed contact with the belts. While this has worked, it also has led to undesired wear upon the interior surfaces of the belts. In one preferred alternative, therefore, all of rollers 58, 60 and 80, 82 are of smooth circumferential contour and a drive link is included as between the upper and lower rollers. As shown in FIG. 8, for example, roller 80′ is provided at one end with a pulley 120. Similarly, roller 82′ carries a pulley 122. Roller 80′ is driven through gear 88 as before. But a flexible belt 124, having internally projecting grips 126, transmissively couples roller 82′ to roller 80′. Better traction between the rollers and the belts may be afforded by a spiral wrap of a strip 128 around each roller; each strip 128 may be composed of rubber foam or a foam type of PVC.

In typical operation, gear motors 73 and 92 serve to drive gears 70, 72 and 88, 90 at about eight revolutions per minute. The overall dimensions are elected such that belts 56 and 74 move at approximately one revolution per minute. The length and width of belts 56 and 74 are such that this results in a movement, of each belt, of about 3200 square feet per minute. With such parameters, the apparatus disclosed has been found to be an effective cooler for a space the size of a conventional mobile home or a building of modest size.

Turning more specifically to the improvements, a wheel or drum 140 has a peripheral wall 142 of cylindrical shape and bounded by space-opposed end walls 144 and 146. A central hub 148 is mounted for rotation on an axle 150 securably mounted from bottom wall 14 as at 151 where it is secured by a plate to a sheet of outlet housing 48.

Disposed between end walls 144 and 146 are a circumferentially-spaced succession of somewhat radially-oriented divider or separator segments 152 which extend from a central recess 153 to peripheral wall 142, and, in this case, define a circumferential succession of eight compartments 154. Formed through end wall 144 in alignment with each of compartments 154 are respective outlet openings 156. Adjacent the radially-inward periphery of each opening 156 is a small lip or spout 158.

Disposed adjacent to end wall 144 and immediately beneath the uppermost ones of openings 156 and their associated spouts 158 at any time is a funnel 160. Funnel 160 communicates with a drain tube 162 which extends downwardly through bottom wall 14 and exhausts to the exterior of the unit.

The structural assembly which includes axle 150 is so positioned that peripheral wall 142 is pressed tightly against belt 56 (and, in this case, 74). Accordingly, movement of belt 56 serves to drive drum 140 in rotation about its central axis. At the same time, axle 150 is so disposed as to cause at least a very lowermost one of openings 156, at any time, to be immersed into reservoir 40 beneath its upper level as controlled by float valve 46. The upper margin of funnel 160 is located above that upper level of reservoir 40, but is situated beneath at least the uppermost one of openings 156 and its associated spout 158 when they are moved to a discharge position.

Preferably also disposed in succession circumferentially around drum 140 are a plurality of vents 164. These openings are spaced outward of outlets 156. As shown, they are located in wall 146. Each individually communicates with a respective difference one of compartments 154.

When an outlet 156 is discharging water, its corresponding vent 164 admits air in order to allow free discharge. When, on the other hand, an outlet 156 is in a lower position, allowing water to enter its associated compartment 154, the corresponding vent allows a free flow of water into the associated compartment. In principle, only vents 164 would need to dip into the reservoir, although that would not allow collection of as much water into each associated compartment on a single revolution of the drum.

During operation, belt 56 (or 74) drives drum 140 in rotation and, thus, causes successive ones of openings 156 to be disposed below the water level. At that time, the immersed opening accepts a small quantity of the water in the reservoir, inletting the same for storage in the respective one of compartments 154. As drum 140 continues to revolve, that predetermined quantity of water is trapped within that compartment and then is elevated to a higher level.

As that particular compartment 154 revolves around axle 150, a position ultimately is reached when the stored contents are outletted back through opening 156 and delivered by spout 158 into the mouth of funnel 160. Accordingly, there is a successive dumping from each compartment of a small quantity of the water within the reservoir. As this sequence continues, float valve 46 operates to add a similar quantity of fresh water to the reservoir. This continuous metering away of the successive small volumes of water, with consequent input of fresh water, well serves to reduce the concentration of contaminates within the reservoir. In turn, that at least increases the time intervals between which it may become necessary to cleanse or replace the evaporative belts.

Of course, the concentration levels of impurities will vary from one water supply to another even within the same geographical area. Consequently, a given user may require a different overall level of dumping or wasting than that which might be desired at some other location. To permit adjustment of the metered amount, the user also is supplied with a plurality of plugs 166. Each plug includes a shank 168 on which is located a nub 170 at one end and a head 172 at the other. Shank 166 is sized to fit snugly within any opening 156, while nub 170 is resilient so as to snap within an opening 156 and force head 172 into a sealing position over that opening. The user, therefore, may adjust his discharge rate by placing one or more plugs 166 in different ones of the openings. That avoids any need for a change in the rate at which belt 56 is caused to move in order to optimize cooling capacity. Plugs 166 may be formed of a suitable resilient plastic or of a material such as rubber.

In operation of the particular evaporative cooler illustrated in FIGS. 1–8, there typically (for home use) is a total capacity in reservoir 42 of three gallons at a depth of about one and one-half (1½) inches. In very hard-water areas, such as in western Oklahoma, satisfactory operation has been obtained with operation of the cooling apparatus to move air at the rate of thirty-three hundred cubic-feet per minute and to meter off or "waste" at a rate of about three-gallons per hour. Total water usage of the overall unit, at average summer temperatures, then is of the order of six gallons per hour.

The additional energy required from the associated gear motor has been found to be insignificant. Of course, a separate motor could be provided for driving wheel 140, or additional coupling to an existing motor might be incorporated rather than using the frictional drive as disclosed. Clearly, the illustrated approach is preferred because of its simplicity of adaptation and its avoidance of need for any additional couplings or other motive drive source.

It also will be observed that the position of the top of funnel 160 is not especially critical. It needs only to be so disposed as to receive the contents progressively dumped from the different ones of the compartments which are used. At the same time, the funnel top may be located sufficiently above the level of water in reservoir 40 that float valve 46 need not be called upon to maintain the reservoir level with a high degree of precision.

While a particular embodiment of the invention has been shown and described, it will be obvious to those skilled in the art that changes and modifications may be made without departing from the invention in its broader aspects and, therefore, the aim in the appended claims is to cover all such changes and modifications as fall within the true spirit and scope of that which is patentable.

I claim:

1. In an evaporative cooling apparatus in which a belt of material, to which a liquid may cling and which is transparent to air flow therethrough so as to achieve evaporation of said liquid, is moved through a reservoir of said liquid and then exposed to said air flow, the combination comprising:

a drum having a continuous peripheral wall substantially closed by space-opposed end walls:

means for mounting said drum for circumferential movement of its periphery:

separating means disposed between said end walls to define a plurality of compartments successively spaced circumferentially around the axis of rotation of said drum;

means defined only in at least one of said end walls for inletting liquid into respective one of said compartments while immersed in the liquid contained within said reservoir and for outletting the liquid from the corresponding compartment in a controllable amount as said drum revolves, said inletting and outletting means including a plurality of openings in only at least one of said end walls and individually communicating with the respective different ones of said compartments;

a plurality of spouts projecting outwardly from said one wall and individually aligned with respective different ones of said openings;

means for effecting rotation of said drum as said belt is moved;

and means for diverting the liquid outletted from said drum away from said reservoir.

2. A system as defined in claim 1 in which said mounting means positions said drum in frictional engagement with said belt, movement of said belt effecting rotation of said drum.

3. A system as defined in claim 1 in which said plurality of openings include outlet openings in at least one of said end walls and inlet vent openings in at least one of said end walls and separate from said outlet openings, with all of those openings being disposed only in one or the other of said end walls;

in which said inlet vent openings are spaced outwardly from said outlet openings;

and in which said openings serve both individually to admit water into the interior of said drum when immersed into said reservoir and to admit air into said interior when spaced above said reservoir.

4. In an evaporative cooling apparatus in which a belt of material, to which a liquid may cling and which is transparent to air flow therethrough so as to achieve evaporation of said liquid, is moved through a reservoir of said liquid and then exposed to said airflow, the combination comprising:

a drum having a continuous peripheral wall substantially closed by space-opposed end walls;

means for mounting said drum for circumferential movement of its periphery;

separating means disposed between said end walls to define a plurality of compartments successively spaced circumferentially around the axis of rotation of said drum;

means defined only in at least one of said end walls for inletting liquid into respective ones of said compartments while immersed in the liquid contained within said reservoir and for outletting the liquid from a corresponding compartment in a controllable amount as said drum revolves;

means for effecting rotation of said drum as said belt is moved;

means for diverting the liquid outletted from said drum away from said reservoir;

and means for selectively closing different ones of said inletting and outletting means.

5. A system as defined in claim 4 in which said inletting and outletting means includes a plurality of openings in at least one of said one walls and said closing means includes a plurality of removable plugs seatable individually within selected ones of said openings.

6. In an evaporative cooling apparatus in which a belt of material, to which a liquid may cling and which is transparent to air flow therethrough so as to achieve evaporation of said liquid, is moved through a reservoir of said liquid and then exposed to said air flow, the combination comprising:

means for selecting and accepting a predetermined volume of liquid in said reservoir;

means for moving said predetermined volume away from said reservoir;

means for discharging said predetermined volume to a location external to said reservoir;

and means for mounting said combination to enable said selecting and moving means to be driven in movement by engagement with and movement of said belt through said reservoir.

7. A system as defined in claim 6 which includes means for adjusting the amount of said predetermined volume.

* * * * *